US006513845B2

(12) United States Patent
Campomane

(10) Patent No.: US 6,513,845 B2
(45) Date of Patent: Feb. 4, 2003

(54) APPARATUS FOR RETRIEVING AND STORING TENNIS BALLS

(76) Inventor: Alberto Alfredo Campomane, Lucio N. Mansilla 2543, 7th Floor "C", Buenos Aires, 1425 (AR)

( * ) Notice: Subject to any disclaimer, the term of this patent is extended or adjusted under 35 U.S.C. 154(b) by 0 days.

(21) Appl. No.: 09/969,775

(22) Filed: Oct. 4, 2001

(65) Prior Publication Data

US 2002/0047283 A1 Apr. 25, 2002

(30) Foreign Application Priority Data

Oct. 23, 2000 (AR) ..... 00 01 05561

(51) Int. Cl.[7] ..... A63B 47/02
(52) U.S. Cl. ..... 294/19.2; 206/315.9
(58) Field of Search ..... 294/19.2, 1.4, 294/55; 206/315.9; 15/257.1, 257.6, 257.7, 104.8; 473/460; 56/327.1, 328.1; 414/440; 280/47.34

(56) References Cited

U.S. PATENT DOCUMENTS 425,695 A * 4/1890 Pontious ..... 15/79.1
4,318,654 A * 3/1982 Lee ..... 294/19.2
4,412,697 A 11/1983 Verde ..... 294/19.2
4,461,504 A 7/1984 Perez et al. ..... 294/19
4,709,440 A * 12/1987 Conelly ..... 15/257.3
4,735,544 A * 4/1988 Stotts ..... 414/440
5,301,991 A 4/1994 Chen et al. ..... 294/19.2
5,860,658 A 1/1999 Callahan ..... 280/30
6,079,930 A * 6/2000 Valdes-Rodriguez ..... 294/19.2
6,142,544 A * 11/2000 Benzoni et al. ..... 280/47.18

* cited by examiner

*Primary Examiner*—Dean J. Kramer
(74) *Attorney, Agent, or Firm*—Jacobson Holman PLLC

(57) ABSTRACT

An apparatus for retrieving tennis balls from a playing surface of a tennis court and for storing the tennis balls either for preventing the same from being removed by non authorized persons or for subsequent removal for playing purposes, either by taking the balls directly from the apparatus of by transferring the balls to another receptacle, the apparatus including a closed container having an open front wall, a ramp at the open wall for receiving the balls and directing the same into the container through the open wall, and a handle and wheels for carrying the container on the playing surface.

18 Claims, 3 Drawing Sheets

APPARATUS FOR RETRIEVING AND STORING TENNIS BALLS

BACKGROUND OF THE INVENTION

1. Field of the Invention.

The present invention relates to an object retrieving apparatus and, more particularly, refers to a ball retrieving and storing apparatus which is easy to operate and carry for retrieving tennis balls from the playing surface of a tennis court and for storing the balls for further use thereof.

While reference will be made in the present specification only to tennis balls, it should be apparent to any person skilled the art that the apparatus is well suited for retrieving and storing other objects, like other ball types, such as golf balls, for example.

2. Description of the Prior Art

It is well known that during a tennis practice or a tennis course, a large supply of balls is used for performing the repetitive drills necessary to acquire a good performance. Either when practicing with an instructor or when using a ball shooting machine, it is quite common that at the end of a practice several tenths of tennis balls remain strewn all around the tennis court. Some times 50 or 300 balls are used for the drillings.

The balls must be retrieved and collected in one container or basket to have a ready supply of balls close to the hand for the next practicing. Generally, basket-like containers or other receptacles are employed by the tennis instructors, the containers and baskets usually having stands or other supports for having comfortable and easy access to the balls. The retrieval of all such balls, however, requires strenuous and repeated stopping for taking each of the balls from the floor and bringing the same into a container. This is why several well known ball retrieving devices have been created for retrieving and collecting the tennis balls from a tennis court.

Among the several ball retrieving apparatii, U.S. Pat. No. 3,371,950 to Stap discloses a device including a wire made ball receptacle having a bottom formed from a plurality of parallel rods spaced apart from each other a distance slightly less than the diameter of the balls to be retrieved. A person carrying the device must place the bottom wall above the balls resting on the court and press the bottom against the balls to squeeze the balls into the receptacle.

U.S. Pat. No. 4,461,504 to Perez P. et al. discloses a tennis ball retriever and carrier comprising a wire made container having a bottom wall with slotted apertures formed by thin parallel rods through which the balls strewn on the court are to be squeezed. Some of the rods include rollers to reduce the frictional resistance to the entry of the balls through the apertures. The device includes a handle and a support for vertically standing on the court.

U.S. Pat. No. 5,301,991 to Chen S. H. et al. discloses a tennis ball retriever and storage cart comprising a wheeled carriage that supports a basket having a bottom including curved side members spaced apart less than the ball diameter defining slotted apertures for entrance of balls into the basket when the device is carried on the tennis court and over the balls. More particularly, at least one of the side members is a deflectable member such that a ball on the ground entering the aperture sideways deflects the deflectable member sufficiently for the balls to pass into the basket.

These ball retrievers have shown to be not efficient and comfortable as long as they are made of heavy materials, like metal rods, and while some of them include wheels for retrieving balls from the floor without the need of lifting the apparatus, the wire nature of these devices prevents the same from sheltering the balls from the weather conditions, this causing the instructor or maintenance personnel to bring the retrieving apparatus or basket, once containing the balls, to an indoor place.

Other devices have been developed different from the wire made devices, such as the one disclosed in the U.S. Pat. No. 5,860,658 to Callahan P., the device comprising a storage receptacle having two articulating arm members movable to different positions, wherein the members form, in a first position, a handle for carrying the receptacle, and in a second position the members form a support for the receptacle, the receptacle having a bottom wall with apertures or rod members. When intended for use as a ball retrieving apparatus, the receptacle must be placed above the ball resting on the floor and pressure must be applied on the handle to force the ball through the aperture or rod members into the receptacle.

While the Callahan apparatus is disclosed as a lightweight device it includes a complex articulating handle and support system and the retrieving operation is similar to the wire made apparatii requiring to place the apparatus above the balls and apply a pressure on the apparatus against the balls and, hence, against the playing surface of the tennis court. When the playing surface is clay, the surface is severely exposed to repeated impacts from the bottom wall of the retrieving apparatus. In addition, since the retrieval is achieved by forcing the balls through resilient apertures and rods, the receptacle can not be left without control from the personnel because the balls can be easily removed from the apparatus even if the cap thereof could be locked into a closed position.

It would be therefore convenient to have a tennis ball retrieving and storing apparatus, a lightweight apparatus capable of being easily carried on a tennis court and retrieving the strewn balls without risks for the playing surface integrity and capable of storing the balls and preventing the same from being damaged from any weather condition and removed from the retrieving and storing apparatus once closed and locked.

SUMMARY OF THE INVENTION

It is therefore one object of the present invention to provide a device for retrieving and storing objects strewn on a floor, preferably tennis balls strewn on a tennis court, the apparatus being a lightweight apparatus for being easily carried on a tennis court for retrieving the strewn balls without spoiling the playing surface of the court, the apparatus being also useful for storing the balls, for sheltering the same from the weather conditions and for preventing the balls from being removed from the apparatus without authorization.

It is still another object of the present invention to provide an apparatus for retrieving tennis balls from a playing surface of a tennis court and for storing the tennis balls either for preventing the same from being removed by non authorized persons or for subsequent removal for playing purposes, either by taking the balls directly from the apparatus or by transferring the balls to other receptacle, the apparatus comprising a close container having an open front wall, a ramp at the open wall for receiving the balls and directing the same into the container through the open wall, and a handle and wheels for carrying the container on the playing surface.

It is a further object of the present invention to provide an apparatus for retrieving and storing objects, like balls, generally strewn on a floor, the apparatus comprising a container having at least one close upper wall, a bottom wall, a rear wall and an open front wall, a ramp at the open wall for receiving the balls and permitting to sweep the balls through the ramp into the container through the open wall, roller means for carrying and supporting said container on a floor at least during the retrieval of the balls, and a handle for enabling an operator to carry the container on the floor either by pushing, or pulling of, the container.

It is even another object of the present invention to provide an apparatus for retrieving tennis balls from a playing surface of a tennis court and for storing the tennis balls either for preventing the same from being removed by non authorized persons or for subsequent removal for playing purposes, the apparatus comprising a container having at least one close upper wall, a bottom wall, a rear wall and an open front wall, a ramp at the open wall for receiving the balls and directing the same into the container through the open wall, roller means for carrying and supporting said container on a floor at least during the retrieval of the balls, and a handle for enabling an operator to carry the container on the floor.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 1:
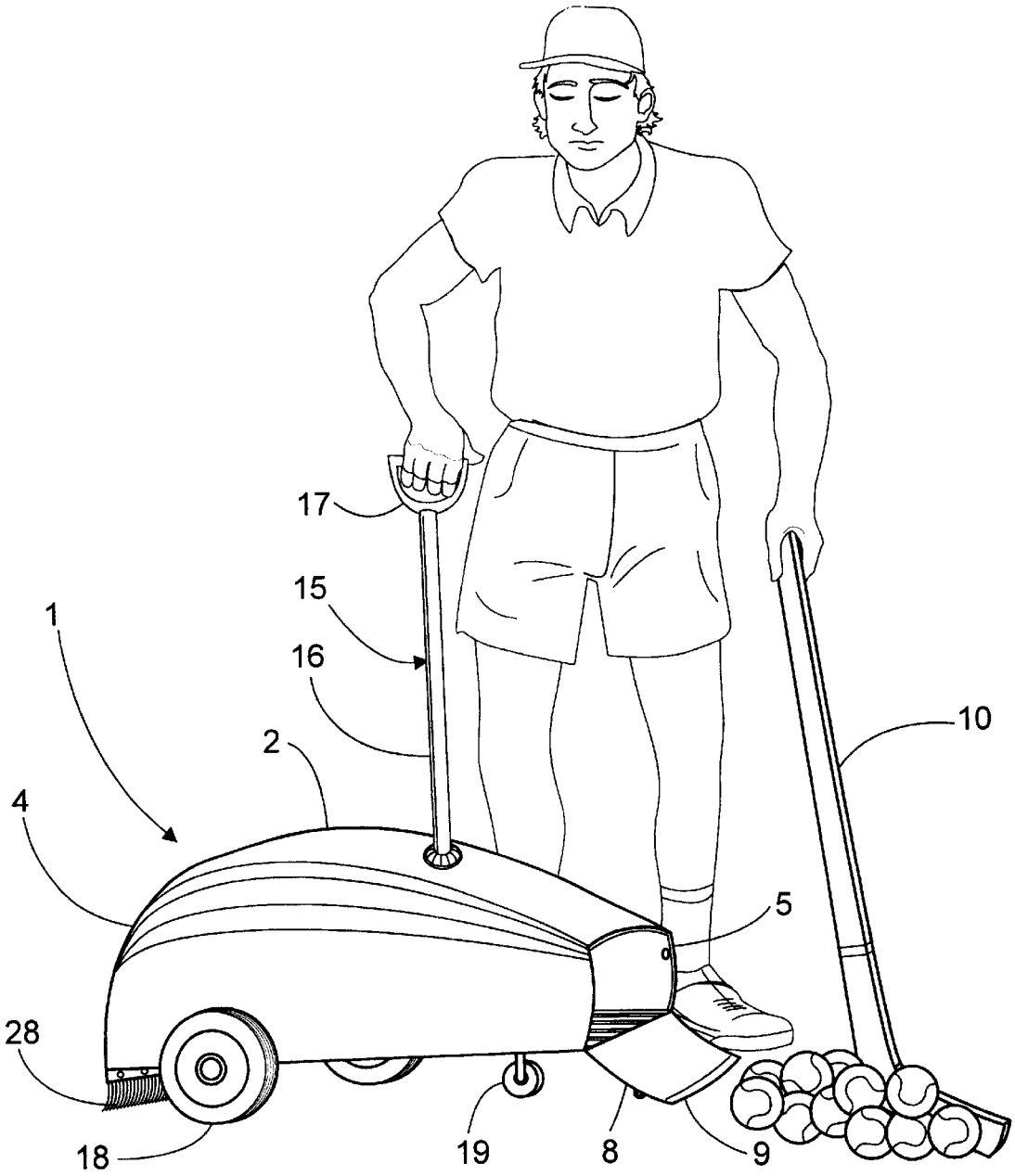
FIG. 1 shows a perspective, side view of a tennis ball retrieving apparatus according to the invention, with a person being diagramatically illustrated while sweeping tennis balls into the container through the ramp lowered into an open position.

Now referring in detail to the drawings it may be seen from all the Figures that the ball retrieving and storing apparatus of the invention is preferably designed for retrieving tennis balls from a playing surface of a tennis court and for storing the tennis balls either for preventing the same from being removed and used by non authorized persons or for subsequent supplying of the balls for playing purposes. The apparatus comprises a container indicated with the generic numeral reference 1, the container having one or more walls such as a close upper wall 2, a bottom wall 3, a close rear wall 4 and an open front wall 5. Since the container is preferably made of lightweight material, such as plastics, with round shapes, it may be that the several walls are not clearly differentiated. Thus, while reference to the upper wall is made, it is clear that sides or side walls 6, 7, more clearly shown in FIG. 5, can also be defined. Also, front wall 5 may be not clearly defined because it is mostly defined by an opening 8 communicating to an interior of the container.

Figure 2:
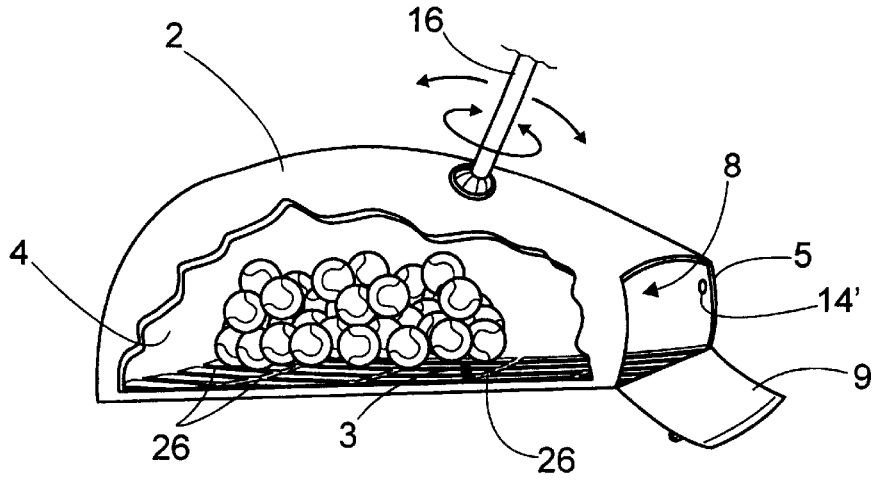
FIG. 2 shows a side perspective, partial cross-sectional view of the apparatus of FIG. 1 with the chassis and wheels being removed for clarity purposes.
Figure 3:
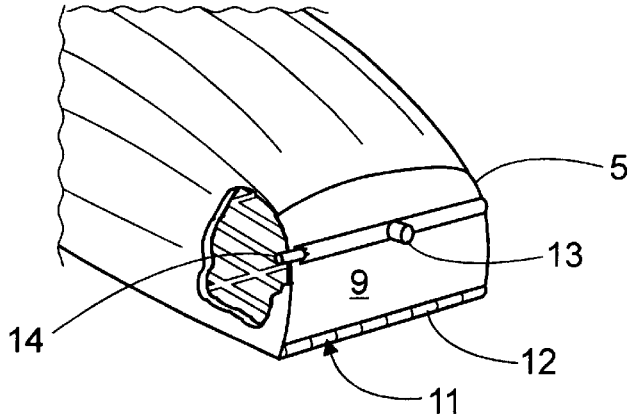
FIG. 3 shows a partial cross-sectional perspective view of the apparatus of the invention, showing details of the front end wall and ramp in closed position.

A ramp 9 is mounted at the open front wall for receiving the balls and directing the same into the container through the open wall when the balls are swept by any appropriate means, such as a sweeping stick 10, a racquet (not shown) or even the feet of the operator. The ramp permits to retrieve the balls more easily, rapidly and comfortably as compared to devices of the prior art. The ramp is preferably mounted in a lower or bottom edge 11 of the front wall by means of a hinge 12. Thus, the ramp can be hingedly moved between an open position, shown in FIGS. 1, 2 and 4, for receiving balls into the container and a closed position, shown in FIG. 3, wherein the ramp closes the open front end for sheltering the stored balls from the weather conditions and for preventing the balls from being removed from the container. For this last purpose, ramp 9, operating as a safety lid, may include a lock 13 further including expandable and contractible pins or bolts 14 capable of extending from the ramp body an into cavities provided in the front wall or inside walls 6, 7, with only one cavity 14' being shown in FIGS. 2 and 4, and only one pin 14 shown in FIG. 3, whereby the lock may be operated by a key so as the bolts are extended to enter into the corresponding cavities.

The container also includes roller means for carrying and supporting said container on a floor, or playing surface, either during the retrieval of the balls or, with the balls already in the container, during the carrying of the container to another place, for storing purposes or for supplying balls again for playing. Since the container is made of a weather resistant material as well as the container may be closed to resist any weather condition, once the balls have been retrieved, container 1 can be left outdoor, in the tennis court, without this being detrimental for the balls. The roller means comprise a pair of rear wheels 18 and at least one front multi-directional wheel 19.

The container is also provided with a multidirectional handle for enabling an operator to carry the container on the floor. Handle 15 comprises a shaft 16 having a bottom end pivotally connected to upper wall 2 and an upper end having a handle portion 17. Handle 15 has a multi-directional movement capacity, as it is indicated by the arrows in FIG. 2, whereby the container can be carried by pulling from the handle or by pushing the handle.

Figure 4:
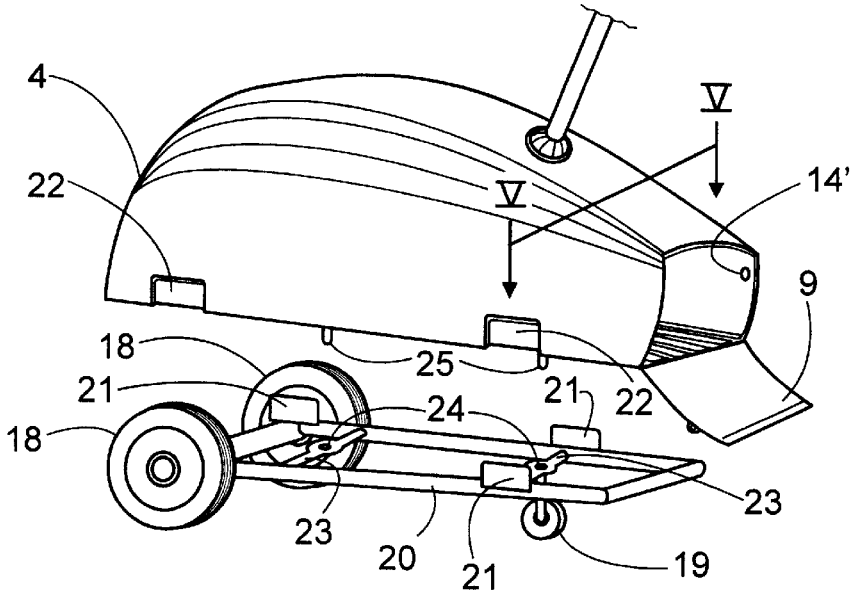
FIG. 4 shows an exploded top perspective view of the apparatus of the invention.

The container has been disclosed as having the roller means, namely wheels 18, 19, directly mounted in the container, however, according to a preferred embodiment of the invention, the container 2 may be mounted in a chassis 20, preferably by means of a removable-type mounting. In this event, rear wheels 18 and front multi-directional wheel 19 are mounted in chassis 20, as shown in FIG. 4. Chassis 20 may be made of light metal tubular rods, such as aluminum, and it may comprise a simple frame with the necessary parts for mounting the container and the wheels.

For the above mentioned removable mounting, chassis 20 includes resilient tongues 21 upwardly extending from the chassis, and the container has recesses 22 at sides thereof for receiving the tongues and forming, together, a snap connection for retaining the container mounted onto the chassis.

The tongue/recess connection retains the container mounted onto the chassis with a force enough to prevent the container from releasing from the chassis when the container and the chassis are carried together, but with a force capable of being overcome by the hand of an operator when the removal of the container from the chassis is desired.

In addition to tongues 21 and recesses 22, chassis 20 may be provided with transverse beams 23 forming part of the frame, each beam 23 including a ring 24 each for receiving a pin 25 pending from the bottom wall of the container. Pins 25 may operate as a guide if the retention is provided by tongues 21 and recesses 22, or may operate as retaining means together with the tongues and recesses or without them. Alternatively, pins and rings may provide retention without the need of the tongues and recesses.

Figure 5:
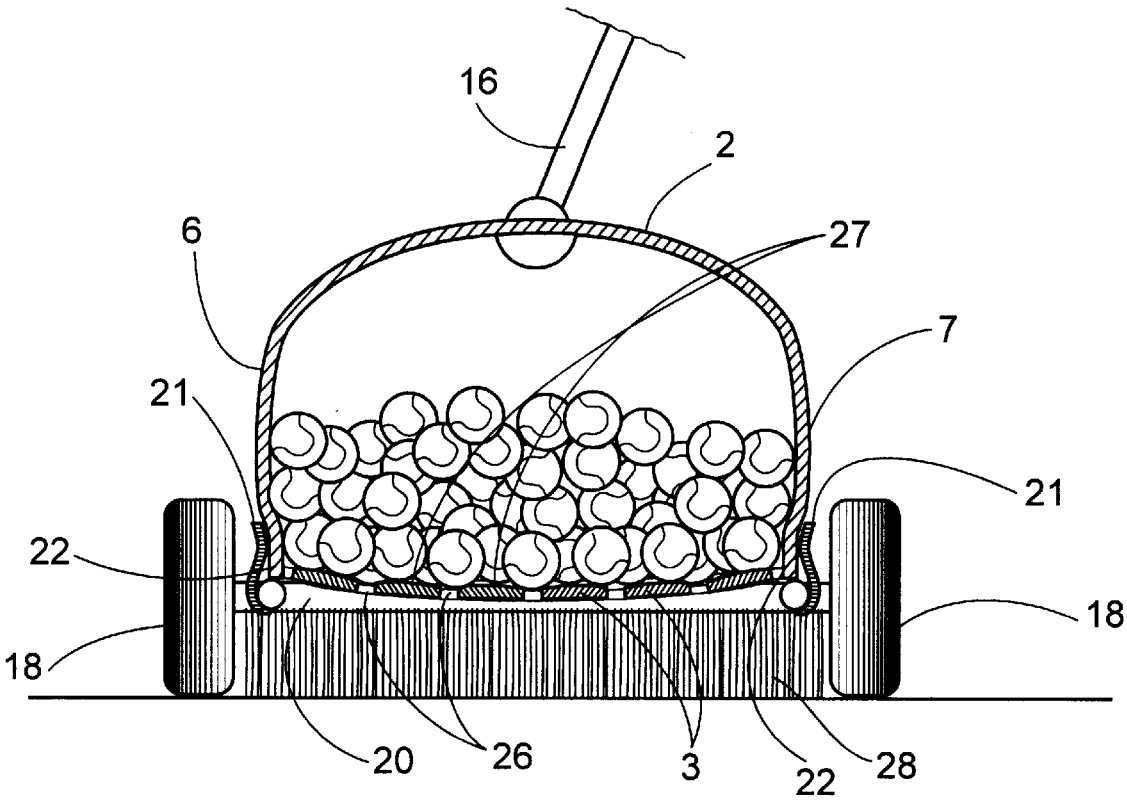
FIG. 5 shows a front cross-sectional view taken along line V—V of FIG. 4.

According to a preferred embodiment, bottom wall 3 is downwardly inclined towards the rear wall, or, as it is illustrated in FIG. 5, it is downwardly curved both in longitudinal and transverse directions, thus forming a kind of bowl, for preventing the balls from escaping through the front opening when in a retrieving operation. This alternative for the bottom is illustrated in FIG. 5 as to its transverse curvature and the longitudinal curvature can be seen in FIG. 2. Also, bottom wall 3 includes means for permitting any debris from the balls to draw off the container. Preferably, wall 3 is a foraminous bottom wall, either provided with orifices, apertures or openings 26 passing through the bottom wall, with the upper surface of the bottom wall being preferably upwardly curved 27 to further facilitate the drawing off. This is particularly important when the balls are used in a clay tennis court.

Figure 6:
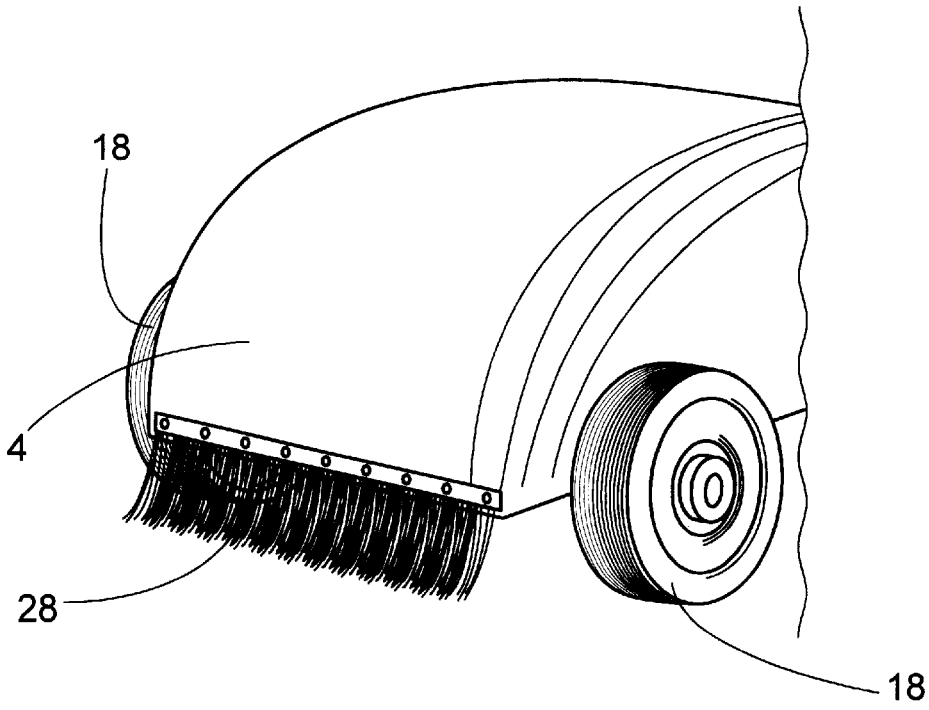
FIG. 6 shows a partial cross-sectional perspective view of the rear end of the apparatus of the invention, showing details of the rake means particularly useful for clay tennis courts.

Also when the inventive apparatus is used in a clay tennis court, the rear part of the container may be provided with rake means 28. If the container is mounted on chassis 20, the rake means will be preferably mounted at a rear portion of the chassis, as it is more clearly shown in FIG. 6. While this rake means may be used in any kind of tennis court, it is preferably used in clay playing surfaces for loosening and/or smoothing the clay during the carrying of the container. Accordingly, rake means are preferably removably mounted by means of any kind of fastening means.

As it is apparent from the above disclosure, the tennis ball retrieving and storing apparatus of the invention, is a lightweight apparatus capable of being easily and comfortably carried on a tennis court, permitting to retrieve the balls more rapidly without risks for the playing surface integrity and capable of storing a higher amount of balls per weight unit, the device also preventing the balls from being affected by any weather condition.

While preferred embodiments of the present invention have been illustrated and described, it will be obvious to those skilled in the art that various changes and modifications may be made therein without departing from the scope of the invention as defined in the appended claims.

I claim:

1. Apparatus for retrieving and storing balls comprising:

a container having at least one upper wall, a bottom wall, a rear wall and an open front wall, a ramp at the open wall for receiving the balls and directing the same into the container through the open wall, roller means for carrying and supporting said container on a floor at least during a retrieval of the balls, and a handle for enabling an operator to carry the container on the floor, the handle including a shaft having a bottom end pivotally connected to the upper wall and an upper end having a handle portion.

2. The apparatus of claim 1, wherein the container is made of a light weather resistant material.

3. Apparatus for retrieving tennis balls from a playing surface of a tennis court and for storing the tennis balls either for preventing the same from being removed by non authorized persons or for subsequent removal for playing purposes, the apparatus comprising:

a container having at least one upper wall, a bottom wall, a rear wall and an open front wall, a ramp at the open wall for receiving the balls and directing the same into the container through the open wall, roller means for carrying and supporting said container on a floor at least during a retrieval of the balls, and a handle for enabling an operator to carry the container on the floor, the upper and rear walls being closed and the ramp being hinged to a bottom edge of the front wall, whereby the ramp can be hingedly moved between an open position for receiving tennis balls into the container and a closed position wherein the ramp closes the open front end for sheltering the stored tennis balls from the weather conditions.

4. The apparatus of claim 3, wherein the playing surface is clay and the bottom wall includes means for permitting any debris and clay from the balls to draw off the container.

5. The apparatus of claim 3, wherein the roller means includes a pair of rear wheels and a front multi-directional wheel.

6. The apparatus of claim 3, wherein the container includes lock means for locking the ramp into the closed position.

7. Apparatus for retrieving and storing balls comprising:

a container having at least one upper wall, a bottom wall, a rear wall and an open front wall, a ramp at the open wall for receiving the balls and directing the same into the container through the open wall, roller means for carrying and supporting said container on a floor at least during a retrieval of the balls, and a handle for enabling an operator to carry the container on the floor, the container being removably mounted in a chassis.

8. The apparatus of claim 7, wherein the roller means comprises a pair of wheels mounted in the chassis.

9. The apparatus of claim 8, wherein the chassis includes resilient tongues upwardly extending from the chassis, and the container having recesses at sides thereof for receiving the tongues and forming, together, a snap connection for retaining the container mounted onto the chassis.

10. The apparatus of claim 7, wherein the roller means comprises a pair of rear wheels and a front multi-directional wheel, the wheels being mounted in the chassis.

11. Apparatus for retrieving and storing balls comprising:

a container having at least one upper wall, a bottom wall, a rear wall and an open front wall, a ramp at the open wall for receiving the balls and directing the same into the container through the open wall, roller means for carrying and supporting said container on a floor at least during a retrieval of the balls, and a handle for enabling an operator to carry the container on the floor, the bottom wall including means for permitting any debris from the balls to draw off the container, the upper and rear walls being closed and the ramp being hinged to a bottom edge of the front wall, whereby the ramp can be hingedly moved between an open position for receiving balls into the container and a closed position wherein the ramp closes the open front end for sheltering the stored balls from the weather conditions.

12. The apparatus of claim 11, wherein the container includes lock means for locking the ramp into the closed position.

13. The apparatus of claim 11, wherein the means for permitting the debris from the balls to draw off the container comprises a plurality of openings.

14. Apparatus for retrieving and storing balls comprising:

a container having at least one upper wall, a bottom wall, a rear wall and an open front wall, a ramp at the open wall for receiving the balls and directing the same into the container through the open wall, roller means for carrying and supporting said container on a floor at least during a retrieval of the balls, a handle for enabling an operator to carry the container on the floor, and a rake at the rear wall of the container.

15. Apparatus for retrieving tennis balls from a playing surface of a tennis court and for storing the tennis balls either for preventing the same from being removed by non authorized persons or for subsequent removal for playing purposes, the apparatus comprising:

a container having at least one upper wall, a bottom wall, a rear wall and an open front wall, a ramp at the open wall for receiving the balls and directing the same into the container through the open wall, roller means for carrying and supporting said container on a floor at least during a retrieval of the balls, and a handle for enabling an operator to carry the container on the floor, the container being removably mounted in a chassis.

16. Apparatus for retrieving tennis balls from a clay playing surface of a tennis court and for storing the tennis balls either for preventing the same from being removed by non authorized persons or for subsequent removal for playing purposes, the apparatus comprising:

a container having at least one upper wall, a bottom wall, a rear wall and an open front wall, a ramp at the open wall for receiving the balls and directing the same into the container through the open wall, roller means for carrying and supporting said container on a floor at least during a retrieval of the balls, a handle for enabling an operator to carry the container on the floor, and rake means at the rear wall of the container for loosening or smoothing the clay of the playing surface during the carrying of the container.

17. The apparatus of claim 16, wherein the rake means is mounted in a rear part of a chassis.

18. Apparatus for retrieving tennis balls from a playing surface of a tennis court and for storing the tennis balls either for preventing the same from being removed by non authorized persons or for subsequent removal for playing purposes, the apparatus comprising:

a container having at least one upper wall, a bottom wall, a rear wall and an open front wall, a ramp at the open wall for receiving the balls and directing the same into the container through the open wall, roller means for carrying and supporting said container on a floor at least during a retrieval of the balls, and a handle for enabling an operator to carry the container on the floor, the container being removably mounted in a chassis by pins pending from the container and entering into corresponding rings in the chassis.

* * * * *